US006652349B1

(12) United States Patent
Wichter

(10) Patent No.: US 6,652,349 B1
(45) Date of Patent: Nov. 25, 2003

(54) ANIMATED HANGING ORNAMENT

(75) Inventor: Steven M. Wichter, Wheeling, IL (US)

(73) Assignee: PBC International, Inc., Oxnard, CA (US)

( * ) Notice: Subject to any disclaimer, the term of this patent is extended or adjusted under 35 U.S.C. 154(b) by 0 days.

(21) Appl. No.: 10/189,996

(22) Filed: Jul. 8, 2002

(51) Int. Cl.[7] ..... A63H 11/00; A63H 13/00; A63H 3/20

(52) U.S. Cl. ..... 446/330; 446/301; 446/343; 446/353

(58) Field of Search ..... 446/330, 301, 446/329, 343, 298, 228, 229, 227, 342, 353

(56) References Cited

U.S. PATENT DOCUMENTS 4,050,342 A * 9/1977 Suzuki et al. ..... 84/95
4,402,158 A * 9/1983 Seki et al.
4,571,208 A * 2/1986 Saigo et al. ..... 446/353
4,575,347 A * 3/1986 Kitamura ..... 446/301
4,652,980 A * 3/1987 Segan ..... 362/86
4,664,640 A * 5/1987 Shindo et al. ..... 446/227
4,670,820 A * 6/1987 Eddins et al. ..... 362/86
4,989,120 A * 1/1991 Davis et al. ..... 362/35
5,320,573 A * 6/1994 Matsuyama ..... 446/358
5,666,750 A * 9/1997 Segan et al. ..... 40/410
6,149,490 A * 11/2000 Hampton et al. ..... 446/353
2002/0089856 A1 * 7/2002 Vogel et al. ..... 362/363

* cited by examiner

*Primary Examiner*—Jacob K. Ackun
*Assistant Examiner*—Ali Abdelwahed
(74) *Attorney, Agent, or Firm*—Michael A. Painter

(57) ABSTRACT

A hanging ornament adapted to be hung from a tree or the like including synchronized, animated elements accompanied by the playback of audible media. A direct current motor powers a plurality of synchronized rocker/cam assemblies, each of which controls and synchronizes the animation of individual facial features which are visible through the ornament housing. An internal source of direct current power energizes the DC motor and, upon activation, energizes the playback of recorded media.

7 Claims, 4 Drawing Sheets

ANIMATED HANGING ORNAMENT

BACKGROUND OF THE INVENTION

1. Field of the Invention

The present generally relates to ornamental decorations and more particularly to ornaments which include animated elements and means for activating prerecorded audible media.

2. Prior Art

The prior art exhibits numerous devices and methods of constructing ornamental products having animated features for the purpose of increasing the variability of the ornament and the commercial value thereof. The animated ornaments disclosed in the prior art typically employ features which can appear to move as the result of weighted elements which will change position upon a change in the orientation of the ornament or doll in which the features are constructed. For example, ornaments in the form of animals or humans have employed eyes which rotate or move based upon the orientation of the object accompanied by eyelids which are weighted and thereby permit the eyelids to open and close upon movement of the ornament or doll.

The prior art also disclosed mechanisms for artificially animating a face with three dimensional facial features. A control system is employed which comprises springs embedded within the simulated lips that are controlled at their terminal ends by pneumatic valves to open or close the mouth. The inadequacies of this construction are inherent in the complexity and size of the mechanism needed to control the features.

The prior art further discloses dolls having internal mechanisms to cause the doll to open and close its mouth, but is limited in the ability to synchronize the features. In particular, conventional mechanisms do not enable synchronized orientation between the eyes and mouth of the ornament or doll and be sufficiently compact to be used as a hanging ornament.

The present invention resolves those defects inherent in the designs disclosed by the prior art. An ornament adapted to be hung from a tree or like support and includes facial features which are internally powered and individually animated. The power source and means for providing the animation force are internal to the ornament. In addition, the animation of the facial features are accompanied by the playback of prerecorded audible media.

SUMMARY OF THE INVENTION

The present invention constitutes an ornament which is adapted to hang from a tree or other support and which internally includes a power source and the mechanism for animating viewable features. Although it is understood the present invention comprises ornaments of any shape which can exhibit any desired viewable elements, the present invention will be discussed in terms of a spherical ornament which exhibits animated facial features.

A spherical shell or housing has apertures disposed therein oriented in the form of the features to be animated. Typically, the apertures will be positioned to portray the eyes and mouth of a human face. Direct current power energizes a direct current motor, the output thereof being a rotating shaft. The rotating motion of the shaft is coupled to a rocker arm/cam assembly which animates a pair of eyes which can be seen through the apertures in the ornament shell. The eyes are mounted upon a pivotable animation shaft which is coupled to the rocker arm/cam assembly. At a speed which is proportional to the rotation of the output shaft of the direct current motor, the animation shaft will pivot about its axis causing the eyes to alternatively move upwardly and downwardly. In a like manner, the output shaft of the direct current motor is coupled to a second rocker arm/cam assembly which in turn controls the motion of the simulated lips. The simulated lips can be pivoted upwardly and downwardly at a speed which is synchronized to the animated motion of the eyes. The direct current power source also energizes the playback of prerecorded audible media.

It is therefore an object of the present invention to provide an improved animated hanging ornament.

It is another object of the present invention to provide a hanging ornament which contains self-powered, animated facial features.

It is still another object of the present invention to provide a hanging ornament which plays prerecorded audible media concurrently with the animated motion of the facial features.

It is still yet another object of the present invention to provide an improved hanging ornament which is inexpensive and simple to fabricate.

The novel features which are believed to be characteristic of the invention, both as to its organization and method of operation, together with further objectives and advantages thereof, will be better understood from the following description considered in connection with the accompanying drawing in which a presently preferred embodiment of the invention is illustrated by way of example. It is to be expressly understood, however, that the drawing is for the purpose of illustration and description only, and is not intended as a definition of the limits of the invention.

DESCRIPTION OF THE PRESENTLY PREFERRED EMBODIMENT

Figure 1:
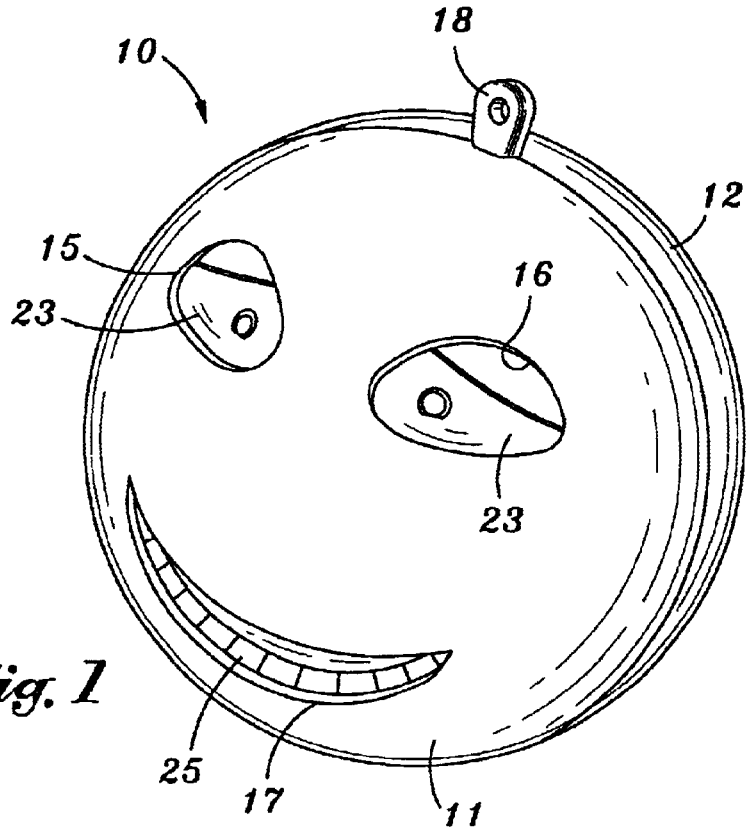
FIG. 1 illustrates a perspective view of a spherical hanging ornament in accordance with the present invention.
Figure 2:
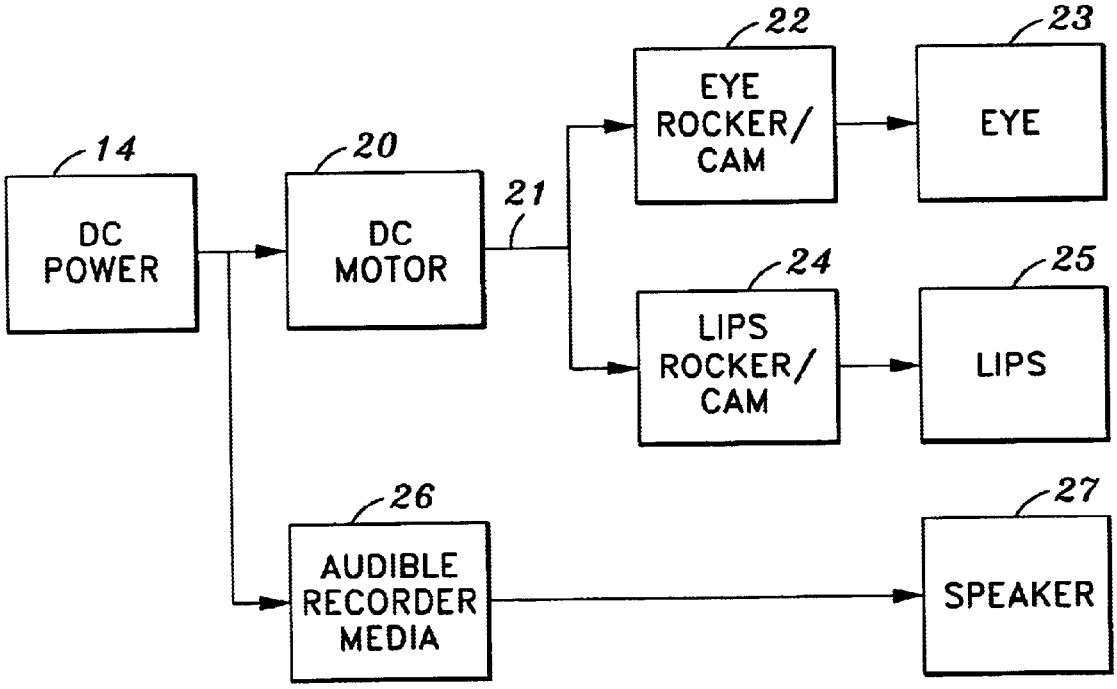
FIG. 2 is a block diagram of the animation mechanism of the present invention animated hanging ornament shown in FIG. 1.
Figure 3:
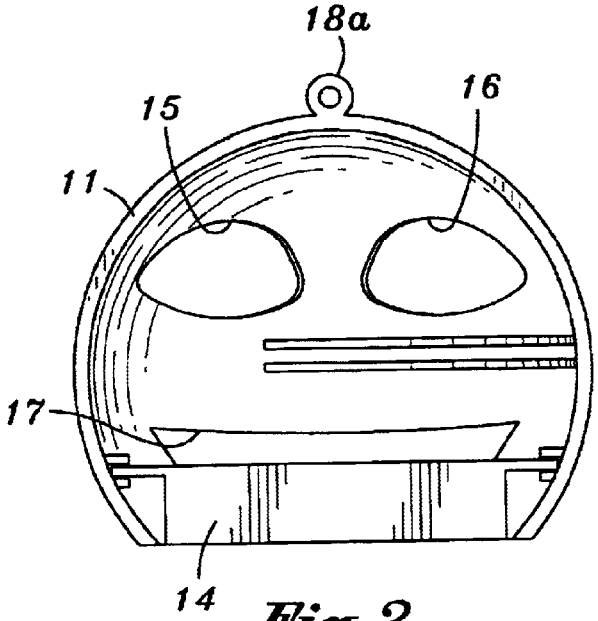
FIG. 3 is a side elevation view of the interior of the front semi-spherical shell shown in FIG. 1.
Figure 4:
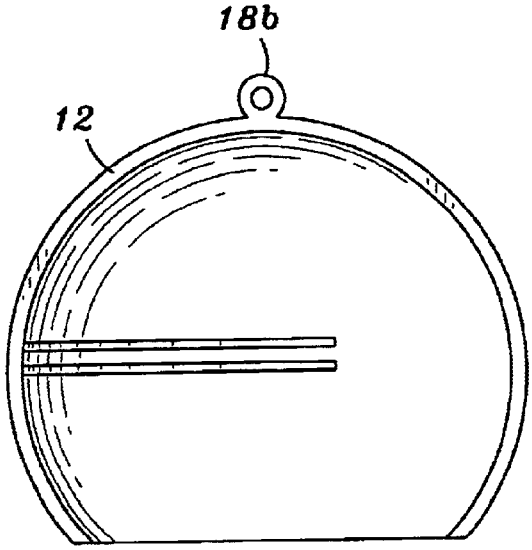
FIG. 4 is a side elevation view of the rear spherical shell shown in FIG. 1.
Figure 6:
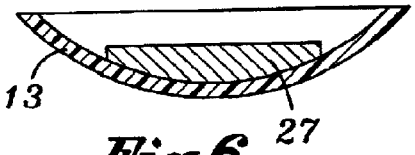
FIG. 6 is a cross-sectional view of the cover element shown in FIG. 5 taken through lines 6—6 of FIG. 5.
Figure 5:
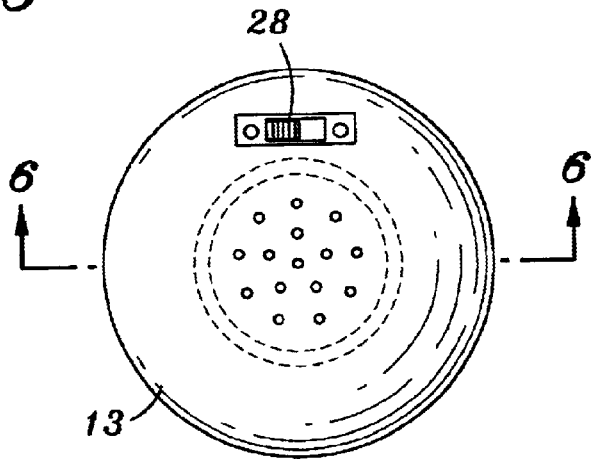
FIG. 5 is an exterior plan view of the cover element and the incorporated speaker grill.
Figure 7:
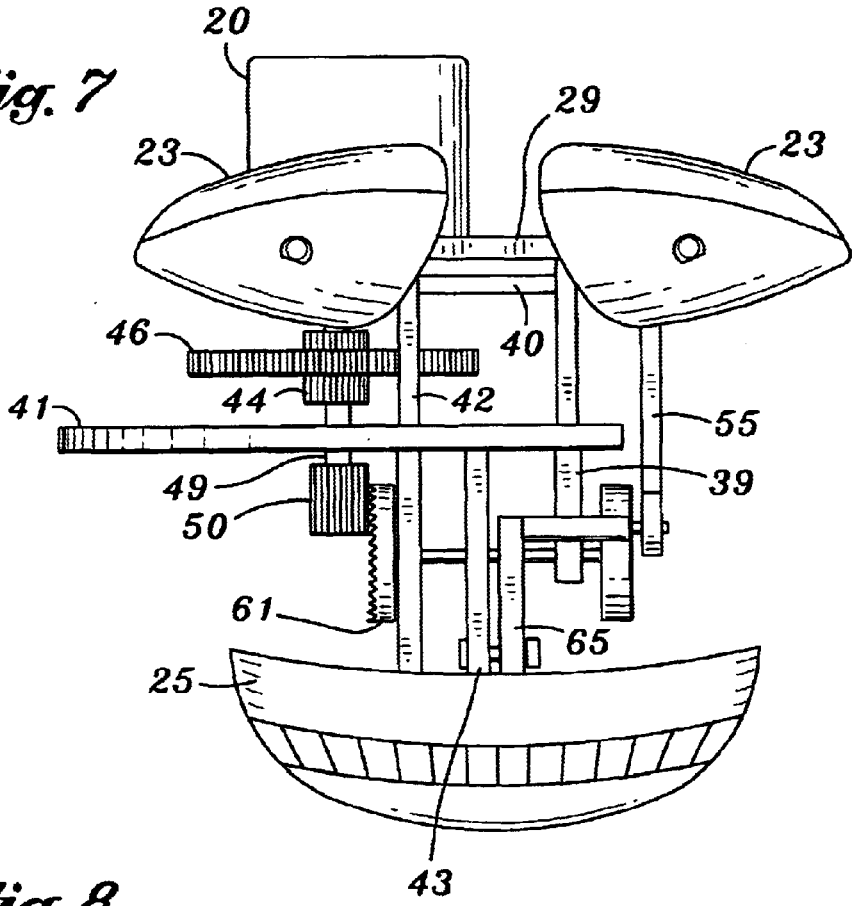
FIG. 7 is a front elevation view of the animation mechanism for animating the eyes and lips of the hanging ornament.
Figure 8:
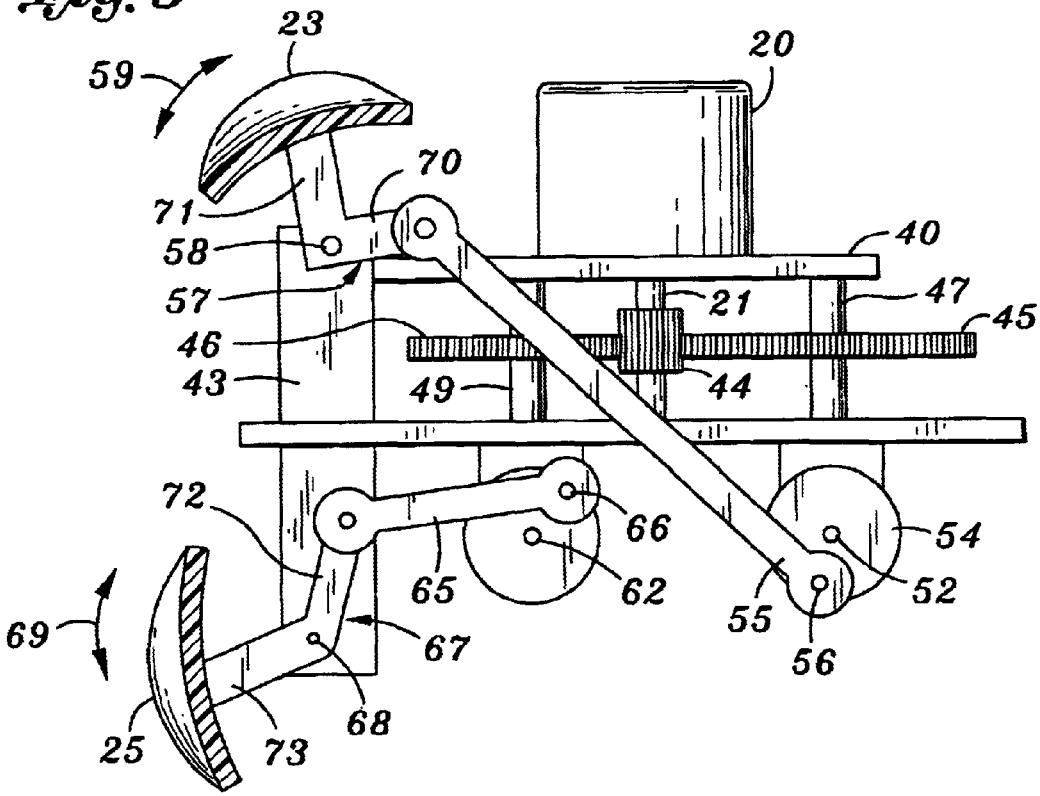
FIG. 8 is a partial cross-sectional, right side elevation view of the animation mechanism illustrating the rocker arm/cam assemblies for animating the facial features shown in FIG. 7.
Figure 9:
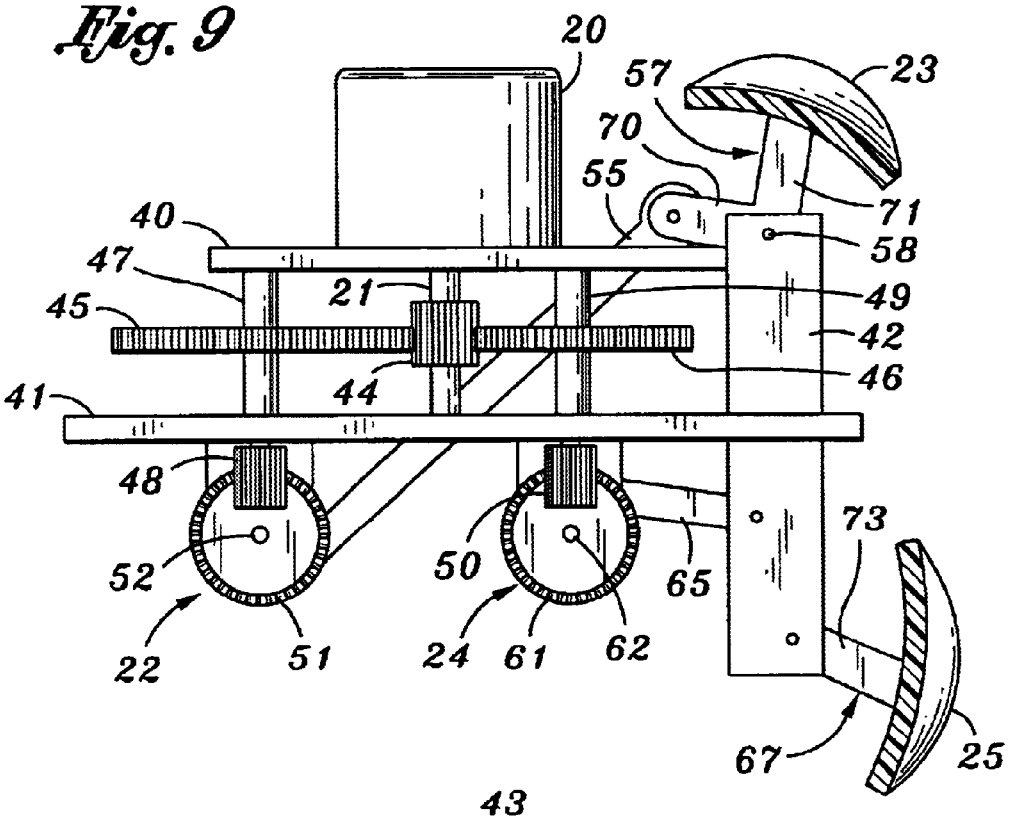
FIG. 9 is a partial cross-sectional, right side elevation view of the animation mechanism illustrating the power drive train to the rocker arm/cam assemblies.
Figure 10:
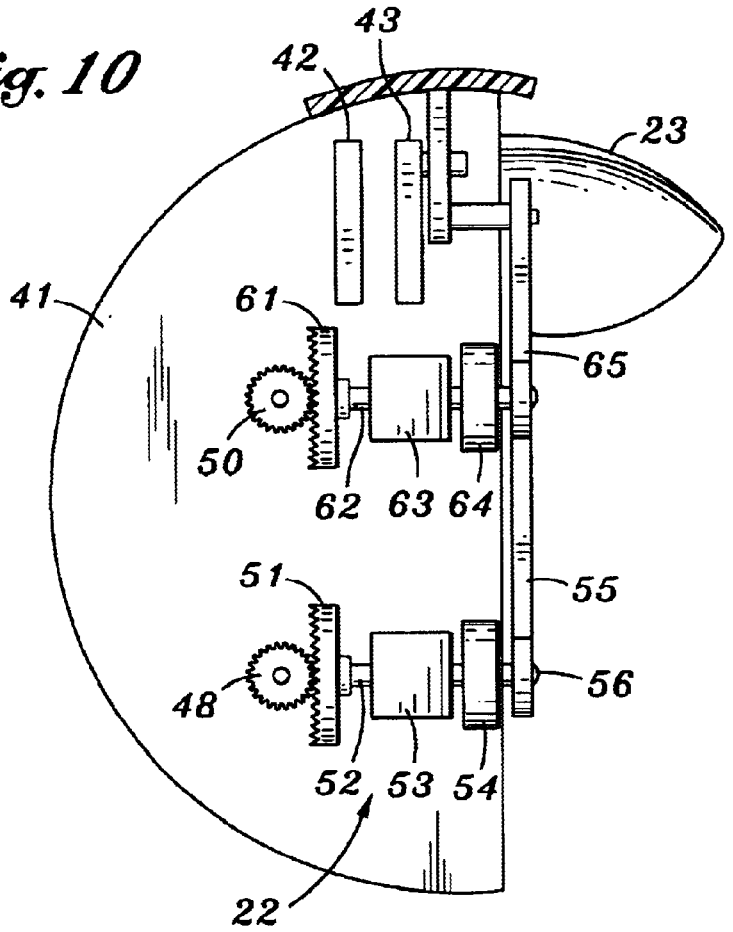
FIG. 10 is a partial cross-sectional, bottom plan view of the rocker arm/cam assemblies shown in FIGS. 8 and 9.

An understanding of the present invention may be best gained by reference to FIG. 1 and FIG. 2, the present invention ornament being generally designated by the reference numeral 10. The present invention ornament 10 is intended to be hung or otherwise supported from a tree or the like. As a result, a primary objective of the present invention is to provide a hanging ornament which includes animated features which includes a self-contained power supply and is light in weight. Although it is understood the scope of the present invention contemplates ornaments of a variety of configurations, the present invention will be discussed in terms of a spherical ornament which includes animated features simulating a human face such as that shown in FIG. 1.

As can be best seen in FIGS. 1 and 3–6, inclusive, the preferred embodiment of the present invention consists of a front semi-spherical shell 11, a rear semi-spherical shell 12, and an access panel 13 which provides access to the internal power supply 14. The joinder of front shell 11, rear shell 12 and access panel 13 comprise the spherical configuration of ornament 10. As will be explained in detail hereinbelow, the power to animate the facial features of ornament 10 is a direct current motor 20. To negate the need for external power, power source 14 will typically be implemented through one or more conventional batteries. The facial features of the present invention ornament 10 are viewable through apertures in front shell 11. As can be best seen in FIG. 1 and FIG. 3, viewing aperture 15 and 16 are adapted to view animated eyes, viewing aperture 17 being suitably positioned and configured to permit viewing of simulated lips. To provide means to hang ornament 10 from a selected support, front and rear shells 11 and 12 include mating segments 18A and 18B, respectively, to form the support ring 18 shown in FIG. 1.

The system elements of the animation mechanism used to implement the present invention hanging ornament 10 may be best seen by reference to FIG. 2. As stated, an objective of the present invention is to provide a hanging ornament which provides animated features which are energized by an internal battery 14. Battery 14 powers a direct current motor 20 through a conventional switch 28, the output 21 thereof being rotating shaft 21. Shaft 21 is coupled to a rocker/cam assembly 22 which provides for animation of the eyes 23 of ornament 10. Two eyes 23 are secured to opposite sides of pivot arm 29. Shaft 21 is also coupled to rocker/cam assembly 24 which animates the lips 25 of ornament 10 in a manner which may be synchronized to the animation of eyes 23. To enhance the overall impression of the present invention hanging ornament 10, battery 14 energizes a conventional audio playback device 26 stored with prerecorded audible media which is connected to a speaker 27 mounted on access panel 13 (FIG. 6) through which the audible media may be heard by the user. It is understood that battery 14 is connected to motor 20 and the audio playback device 26, the wiring not being shown.

The drive assembly for animating the eyes 23 and lips 25 can be best understood by reference to FIGS. 7–10, inclusive. The elements of the drive assembly are mounted upon upper and lower main support plates 40 and 41, respectively. Main support plates 40 and 41 are maintained in parallel spaced relation by support flanges 39, 42 and 43. Motor 20 is secured to upper support plate 40, output shaft 21 extending through support plate 40 and being suitable journeled within support plate 41. Main drive gear 44 is axially secured about output shaft 21 and is adapted to engage first and second driven gears 45 and 46 which transfer power to rocker/cam assemblies 22 and 24, respectively.

Driven gear 45 is secured about shaft 47. Shaft 47 is rotatably coupled between main support plates 40 and 41, a portion of shaft 47 extending through main support plate 41 and being axially coupled to secondary drive gear 48. In a like manner, driven gear 46 is secured about shaft 49 which is journeled between main support plates 40 and 41, a portion thereof extending through main support plate 41 and axially coupled to secondary drive gear 50. It can therefore be seen that operation 22 and 24.

Rocker/cam assembly 22 is powered by secondary drive gear 48. Secondary drive gear 48 is engaged to and transmits rotational power to receiving gear 51. Receiving gear 51 is axially secured to axle 52 which is rotatably coupled to the bottom surface of lower support plate 41 by first mounting bracket 53. Circular cam 54 is secured to axle 52 in axial opposition to receiving gear 51. As can be seen best in FIG. 8, linkage arm 55 is rotatably coupled to pivot pin 56 along the periphery or circumference of circular cam 54. Rocker arm 57 consists of first and second integral segments 70 and 71 which are oriented with respect to each other by an oblique angle. Linkage arm 55 is coupled to the end of segment 70 of rocker arm 57. The animated feature in the form of eyes 23 are secured to the terminus of segment 71 of rocker arm 57. Rocker arm 57 is pivotable about pivot pin 58 which is intermediate segments 70 and 71 of rocker arm 57. As circular cam 54 rotates, rocker arm 57 and animated eyes 23 will alternatively pivot about pin 58 in a range depicted by reference numeral 59. The oblique orientation of segments 70 and 71 of rocker arm 57 will determine the magnitude of angular range 59.

Rocker/cam assembly 24 is powered by secondary drive gear 50. Secondary drive gear 50 is engaged to and transmits rotational power to receiving gear 61. Receiving gear 61 is axially secured to axle 62 which is rotatably coupled to the bottom surface of lower support plate 41 by second mounting bracket 63. Circular cam 64 is secured to axle 62 in axial opposition to receiving gear 61. As can be best seen in FIG. 8, linkage arm 65 is rotatably coupled to pivot pin 66 which is secured along the periphery or circumference of circular cam 64. Rocker arm 67 consists of first and second integral segments 72 and 73 which are oriented with respect to each other by an oblique angle. Linkage arm 65 is coupled to the end of segment 72 of rocker arm 67. The animated feature in the form of lips 25 are secured to the terminus of segment 73 of rocker arm 67. Rocker arm 67 is pivotable about pivot pin 68 which is intermediate segments 72 and 73 of rocker arm 67. As circular cam 64 rotates, rocker arm 67 and animated lips 25 will pivot about pin 68 in a range depicted by reference numeral 69. The oblique orientation of segments 72 and 73 of rocker arm 67 will determine the angular range 69.

As stated, it is an objective of the present invention to synchronize the movement of lips 25 with those of eyes 23. By changing the configuration of rocker arms 57 and 67 and/or the relative sizes of first and second driven gears 45 and 46, the relative magnitude and speed of the animated movements of eyes 23 and lips 25 may be synchronized into any preselected pattern.

The present invention animated hanging ornament solves those problems which are inherent in similar devices disclosed by the prior art. The present invention ornament is intended to be self-contained and be able to be suspended from a tree, bush or the like without any external source of power. When activated, the direct current motor 20 will active rocker/cam assemblies 22 and 24 which will animate eyes 23 and lips 25, respectively. By adjusting the rocker arms 57 and 67 and/or the gears which are part of rocker/cam assemblies 22 and 24, the relative movement of the eyes 23 and lips 25 can be synchronized to mimic facial expressions. To further enhance the desirability of the present invention, when the present invention is turned on through the activation of switch 28, audible playback media will be emitted from speaker 27 as accompaniment for the animated facial expressions of the present invention ornament 10.

I claim:

1. An animated hanging ornament comprising:

(a) a housing having an inner and an outer surface and a plurality of apertures disposed therethrough;

(b) a main frame coupled to said housing within the inner surface thereof;

(c) moveable facial features depicting eyes and lips coupled to said main frame, each of said facial features being viewable through one of said housing apertures;

(d) a direct current power source coupled to the inner surface of said housing;

(e) a direct current motor connected to the power source and secured to said main frame, said motor having a rotatable shaft; and (f) first and second rocker/cam assemblies each coupled intermediate the rotatable shaft of said motor and one of said eyes and lips respectively each comprising:

(i) a driven gear coupled to the rotatable shaft of said motor;

(ii) a circular cam coupled to the driven gear;

(iii) a linkage arm having first and second ends, the first end being coupled to said circular cam adjacent the circumference thereof; and (iv) a rocker arm having first and second segments which are obliquely oriented with respect to each other, said first segment being pivotally coupled to the second end of said linkage arm and said second segment being pivotally coupled to one of said facial features, said rocker arm being pivotally coupled to said main frame intermediate the first and second segments thereof whereby the eyes and lips will be moved when activated by the rotatable shaft whereby the movement of said eyes and lips are synchronized with one another.

2. An animated hanging ornament as defined in claim 1 wherein said housing is spherical.

3. An animated hanging ornament as defined in claim 1 wherein said housing is defined by a front and a rear substantially semi-spherical shell and an access panel which are adapted to be coupled to one another to create a spherical housing.

4. An animated hanging ornament as defined in claim 1 including playback means for playing audible media coupled to said power source within said housing.

5. An animated hanging ornament as defined in claim 4 including an audio speaker secured to the inner surface of said housing and being connected to said playback means.

6. An animated hanging ornament as defined in claim 1 wherein the oblique orientation of the first and second segments of the rocker arm of said first rocker/cam assembly determine the magnitude of the angular range of movement of the eyes.

7. An animated hanging ornament as defined in claim 1 wherein the oblique orientation of the first and second segments of the rocker arm of said second rocker/cam assembly determine the magnitude of the angular range of movement of the lips.

* * * * *